US009610670B2

(12) United States Patent
Lancaster-Larocque et al.

(10) Patent No.: US 9,610,670 B2
(45) Date of Patent: Apr. 4, 2017

(54) CONSUMABLE ABRASIVE TOOL FOR CREATING SHINY CHAMFER

(71) Applicant: Apple Inc., Cupertino, CA (US)

(72) Inventors: Simon Regis Louis Lancaster-Larocque, Gloucester (CA); Collin D. Chan, San Jose, CA (US)

(73) Assignee: Apple Inc., Cupertino, CA (US)

( * ) Notice: Subject to any disclaimer, the term of this patent is extended or adjusted under 35 U.S.C. 154(b) by 425 days.

(21) Appl. No.: 14/167,601

(22) Filed: Jan. 29, 2014

(65) Prior Publication Data

US 2014/0364043 A1 Dec. 11, 2014

Related U.S. Application Data

(60) Provisional application No. 61/832,637, filed on Jun. 7, 2013.

(51) Int. Cl.

| | |
|---|---|
| ***B24B 9/00*** | (2006.01) |
| ***B24D 11/00*** | (2006.01) |
| ***B24B 29/00*** | (2006.01) |
| ***B24D 13/00*** | (2006.01) |

(52) U.S. Cl.

CPC ..... *B24B 9/00* (2013.01); *B24B 29/005* (2013.01); *B24D 11/00* (2013.01); *B24D 13/00* (2013.01)

(58) Field of Classification Search

CPC ..... B24B 9/00; B24B 29/05; B24B 55/02; B24D 11/00; B24D 11/001

USPC ..... 451/54, 59, 449, 488, 495, 536, 532

See application file for complete search history.

(56) References Cited

U.S. PATENT DOCUMENTS

| | | | | | |
|---|---|---|---|---|---|
| 1,427,503 | A * | 8/1922 | Wake | A61C 3/06 | 132/76.4 |
| 2,099,030 | A * | 11/1937 | Morrison | B44D 2/00 | 132/320 |
| 3,696,563 | A * | 10/1972 | Rands | B24D 18/00 | 15/197 |
| 3,871,139 | A * | 3/1975 | Rands | B24B 39/006 | 15/104.066 |

(Continued)

FOREIGN PATENT DOCUMENTS

| | | |
|---|---|---|
| CN | 1092434 | 9/1994 |
| CN | 1451340 A | 10/2003 |

(Continued)

OTHER PUBLICATIONS

Chinese Patent for Utility Model No. ZL201420300123.2—Evaluation Report for Utility Model Patent dated Mar. 6, 2015.

(Continued)

*Primary Examiner* — Eileen Morgan
(74) *Attorney, Agent, or Firm* — Downey Brand LLP

(57) ABSTRACT

The disclosed embodiments relate generally to methods for creating smooth cosmetic surfaces along small features of an electronic device. The disclosed embodiments are well suited for reaching surfaces disposed in constrained spaces. More specifically a method for finishing a workpiece is described. For example, the method may be employed to finish an inlet portion of a cable connector. The method may involve the use of an abrasive brush which may include a single filament and abrasive particles coupled thereto, which can be configured to provide any number of different surface geometries during a finishing operation.

20 Claims, 13 Drawing Sheets

(56) References Cited

U.S. PATENT DOCUMENTS 4,128,971 A * 12/1978 Dunnington ..... B24D 7/02 175/425
5,211,725 A * 5/1993 Fowlie ..... B24D 13/10 451/466
5,427,595 A * 6/1995 Pihl ..... A01D 34/4168 428/361
5,460,883 A * 10/1995 Barber, Jr. ..... A46D 1/00 428/370
5,616,411 A * 4/1997 Barber, Jr. ..... A46D 1/00 428/364
5,649,943 A * 7/1997 Amoils ..... A46B 13/02 606/107
5,679,067 A * 10/1997 Johnson ..... A46B 3/005 451/527
5,766,060 A * 6/1998 Foreman ..... B24B 7/16 451/466
5,890,252 A * 4/1999 Mellon ..... H01R 43/002 15/104.001
5,983,434 A * 11/1999 Eichinger ..... B24D 13/145 15/179
6,095,910 A * 8/2000 Luedeke ..... B24B 29/005 451/359
6,352,471 B1 * 3/2002 Bange ..... A46B 3/005 451/527
6,412,139 B1 * 7/2002 Weihrauch ..... A46B 15/0002 15/159.1
6,669,746 B2 * 12/2003 Niizaki ..... A46D 1/00 51/298
9,102,029 B2 * 8/2015 Palushaj ..... A46B 13/008
2002/0094437 A1 * 7/2002 Niizaki ..... A46D 1/00 428/364
2004/0148866 A1 * 8/2004 Krupnick ..... B24D 11/001 51/295
2006/0117506 A1 * 6/2006 Gavney, Jr. ..... A61C 17/3436 15/22.1
2007/0272674 A1 * 11/2007 Koh ..... B24B 53/00 219/390
2009/0049964 A1 2/2009 Yagyu et al.
2010/0068042 A1 * 3/2010 Bruck ..... F16J 15/3288 415/174.2
2010/0282276 A1 * 11/2010 Kueper ..... B24B 7/06 134/6
2012/0071071 A1 3/2012 Boudreau
2013/0157548 A1 * 6/2013 Palushaj ..... A46B 13/008 451/294

FOREIGN PATENT DOCUMENTS

| | | | |
|---|---|---|---|
| CN | 2629912 | Y | 8/2004 |
| CN | 1958232 | A | 5/2007 |
| CN | 102131619 | | 7/2011 |
| CN | 204094650 | U | 1/2015 |
| JP | H08155839 | | 6/1996 |
| JP | 2011101927 | | 5/2011 |
| KR | 20030050271 | A | 6/2003 |
| WO | WO2010137189 | | 12/2010 |

OTHER PUBLICATIONS

Chinese Application for invention No. 201410249614.3—First Office Action dated Feb. 24, 2016.

* cited by examiner

CONSUMABLE ABRASIVE TOOL FOR CREATING SHINY CHAMFER

CROSS-REFERENCE TO RELATED APPLICATIONS

This application claims the benefit priority under 35 U.S.C §119(e) to U.S. Provisional Application No. 61/832,637, filed on Jun. 7, 2013, the disclosure of which is incorporated herein by reference in its entirety.

FIELD

The described embodiments relate generally to methods for creating smooth cosmetic surfaces along small features of an electronic device. More specifically a method for finishing relatively small features defining complex geometries (e.g., an inlet portion of a cable connector) is described.

BACKGROUND

Components employed to form various devices such as computing devices often undergo numerous manufacturing operations during the production thereof. Additive manufacturing processes add material to form a component. By way of example, injection molding may be employed to form a component. Conversely, subtractive manufacturing processes remove material from a workpiece or substrate to form a component. For example, material may be machined from a substrate to form the component. In some embodiments additive and subtractive processes may both be employed to form a component, depending on the particular desired final configuration of the component.

Computer numerical control (CNC) machining is one example of a type of subtractive manufacturing process commonly employed to form components. CNC machining typically employs a robotic assembly and a controller. The robotic assembly may include a rotating spindle to which a milling cutter, or an alternate embodiment of cutter, is coupled. The cutter includes cutting edges that remove material from a substrate to form a component defining a desired shape and dimensions. In this regard, the controller directs the robotic assembly to move the cutter along a machining path that forms the component. However, CNC machining may not provide a desired surface finish.

Surface finishing methods and apparatuses are available for creating a wide variety of finishes for a cosmetic surface. Unfortunately, tools adapted for finishing surfaces disposed in tight spaces are not so abundant and may not produce desirable results. In this regard, by way of example, it may be difficult to perform finishing operations on apertures configured to receive connectors (e.g., data connectors), which are progressively decreasing in size. For example, while polycrystalline diamond (PCD) cutters and monocrystalline diamond (MCD) cutters may be suited for finishing surfaces disposed in tight spaces, a resulting surface finish can include cutting marks (e.g., scallops) across a cosmetic surface of the part. Further, abrasive brushes may be employed for finishing operations, but such abrasive brushes may generally be configured for finishing relatively flat surfaces.

Therefore, what is desired is a reliable way for creating a fine surface finish to a surface of a part disposed in a tight space.

SUMMARY

This paper describes various embodiments that relate to finishing a small feature of a part.

In one embodiment an abrasive brush is disclosed. The abrasive brush may include the following components: a single filament, the filament having a number of abrasive particles coupled thereto (e.g., impregnated therein); and a retractable collar configured to shift up as the single filament is consumed during a finishing operation. The hardness of the single filament may be selected in accordance with a clogging rate of the abrasive brush given the material against which the single filament abrasive brush is configured to be applied.

Other aspects and advantages of the present disclosure will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
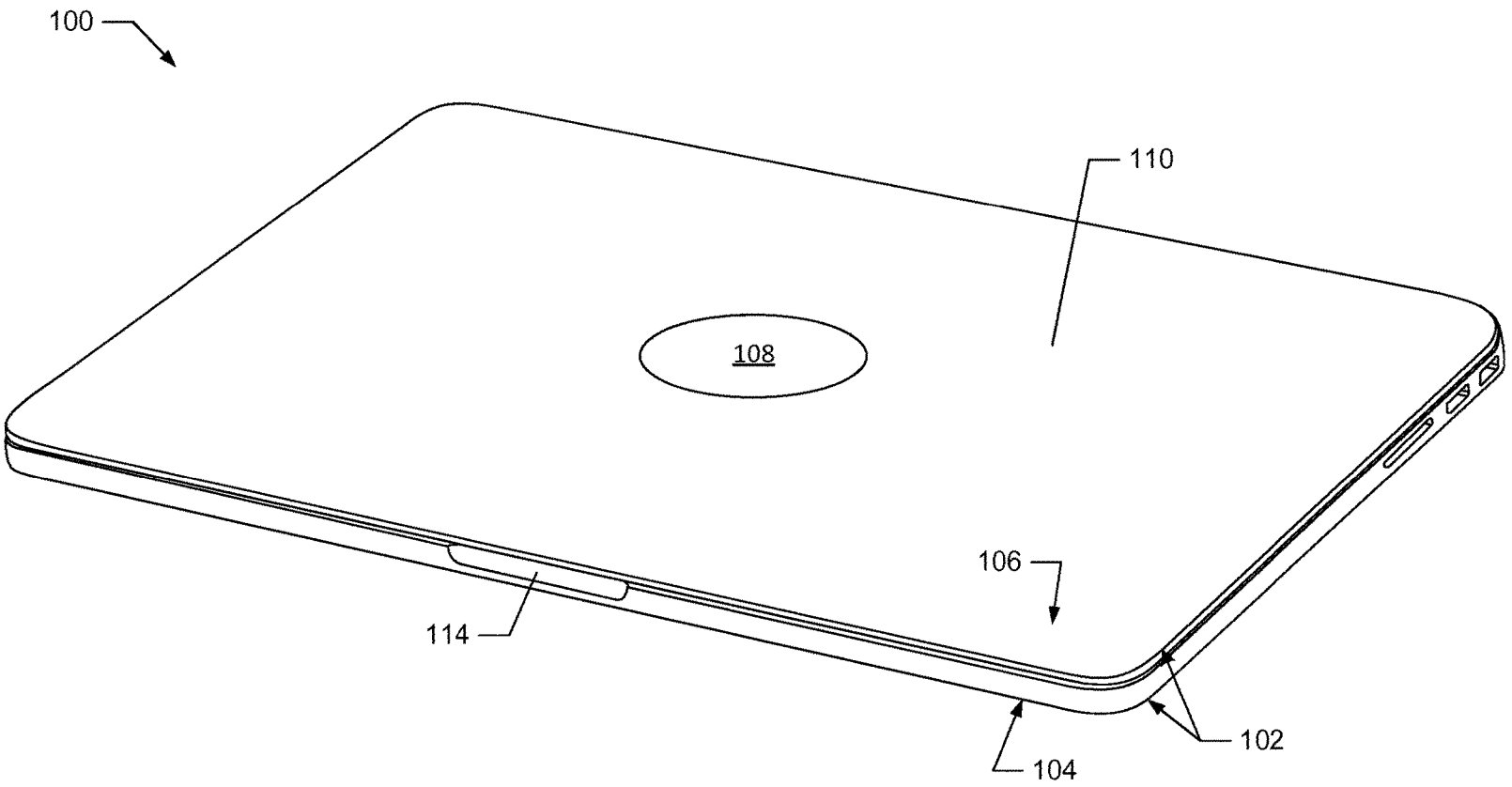
FIG. 1 illustrates a front facing perspective view of an embodiment of the portable computing device in a closed configuration according to an example embodiment of the present disclosure.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Grinding operations, which commonly utilize a grinding wheel, generally allow a manufacturer to produce an edge substantially having a desired surface geometry. Any left-over burrs that are not cleared from a surface of the created geometry by the grinding wheel can in some cases be removed by a finishing brush. A finishing brush is typically placed in a spindle and the abrasive bristles of the brush are useful for clearing any machining artifacts from a surface of the part. The finishing brush is also advantageous in that it is generally gentle enough so that an established geometry of the part is not changed by the finishing brush operations.

Unfortunately, a grinding wheel cannot be used to form small features in a given workpiece. One feature which may be difficult or impossible to form using a standard grinding wheel is a chamfered port inlet. Although this exemplary embodiment of a feature will be used for a large portion of this specification, it should be understood that the described processes can be applied to any small and/or complex features of a workpiece. For example, the tools and methods described herein may also be employed to finish rounds, fillets, sidewalls, and/or any other feature of a workpiece, particularly in instances in which the feature is relatively small and/or difficult to access.

These and other embodiments are discussed below with reference to FIGS. 1-17; however, those skilled in the art will readily appreciate that the detailed description given herein with respect to these figures is for explanatory purposes only and should not be construed as limiting.

As described in detail below, the following relates to manufacturing and finishing tools, assemblies, apparatuses, systems, devices, computer program products, and methods. Embodiments of the disclosure may be employed to form a variety of components including, for example, electronic devices. By way of more specific example, the manufacturing and finishing methods disclosed herein may be employed to form a computing device such as a desktop computer, a laptop computer, a net book computer, a tablet computer, a cellphone, a smartphone, etc., or any accessory therefor such as a keyboard and a monitor. Thus, purely for purposes of example, embodiments of a portable computing device that may be formed by these manufacturing methods are described and illustrated herein. However it should be understood that various other embodiments of devices may be formed and finished using the tools, assemblies, apparatuses, systems, devices, computer program products, and methods of the present disclosure.

In one embodiment a portable computing device can include a multi-part housing having a top case and a bottom case joining at a reveal to form a base portion. The portable computing device can have an upper portion (or lid) that can house a display screen and other related components whereas the base portion can house various processors, drives, ports, battery, keyboard, touchpad and the like. The top case and the bottom case can each be joined in a particular manner at an interface region such that the gap and offset between top and bottom cases are not only reduced, but are also more consistent from device to device during the mass production of devices.

In a particular embodiment, the lid and base portion can be pivotally connected with each other by way of what can be referred to as a clutch assembly. The clutch assembly can include at least a cylindrical portion that in turn includes an annular outer region, and a central bore region surrounded by the annular outer region, the central bore suitably arranged to provide support for electrical conductors between the base portion and electrical components in the lid. The clutch assembly can also include a plurality of fastening regions that couple the clutch to the base portion and the lid of the portable computing device with at least one of the fastening regions being integrally formed with the cylindrical portion such that space, size and part count are minimized.

The top case can include a cavity, or lumen, into which a plurality of operational components can be inserted during an assembly operation. In the described embodiment, the operational components can be inserted into the lumen and attached to the top case in a "top-bottom" assembly operation in which top most components are inserted first followed by components in a top down arrangement. For example, the top case can be provided and shaped to accommodate a keyboard module. The keyboard module can include a keyboard assembly formed of a plurality of keycap assemblies and associated circuitry, such as a flexible membrane on which can be incorporated a switching matrix and protective feature plate. Therefore, following the top-bottom assembly approach, the keyboard assembly is first inserted into the top case followed by the flexible membrane and then the feature plate that is attached to the top case.

Other internal components can then be inserted in a top to bottom manner (when viewed from the perspective of the finished product).

In one embodiment, the keyboard module can be configured in such a way that a keycap assembly can be used to replace a power switch. For example, in a conventional keyboard each of a top row of keycaps can be assigned at least one function. However, by re-deploying one of the keycaps as a power button, the number of operational components can be reduced by at least eliminating the switch mechanism associated with the conventional power button and replacing it with the already available keycap assembly and associated circuitry.

In addition to the keyboard, the portable computing device can include a touch sensitive device along the lines of a touch pad, touch screen, etc. In those embodiments where the portable computing device includes a touch pad the touch pad can be formed from a glass material. The glass material provides a cosmetic surface and is the primary source of structural rigidity for the touchpad. The use of the glass material in this way significantly reduces the overall thickness of the touchpad compared to previous designs. The touchpad can include circuitry for processing signals from a sensor associated with the touchpad. In one embodiment, the circuitry can be embodied as a printed circuit board (PCB). The PCB can be formed of material and placed in such a way that it provides structural support for the touchpad. Thus, a separate touchpad support is eliminated.

In one embodiment, the top case can be formed from a single billet of aluminum that is machined into a desired shape and size. The top case can include an integrated support system that adds to the structural integrity of the top case. The integrated support system can be continuous in nature in that there are no gaps or breaks. The integrated support system can be used to provide support for individual components (such as a keyboard). For example, the integrated support system can take the form of ribs that can be used as a reference datum for a keyboard. The ribs can also provide additional structural support due to the added thickness of the ribs. The ribs can also be used as part of a shield that helps to prevent light leaking from the keyboard as well as act as a Faraday cage that prevents leakage of extraneous electromagnetic radiation.

The continuous nature of the integrated support system can result in a more even distribution of an external load applied to the multi-part housing resulting in a reduced likelihood of warping, or bowing that reduces risk to internal components. The integrated support system can also provide mounting structures for those internal components mounted to the multi-part housing. Such internal components include a mass storage device (that can take the form of a hard disk drive, HDD, or solid state drive, SSD), audio components (audio jack, microphone, speakers, etc.) as well as input/output devices such as a keyboard and touch pad.

These and other embodiments are discussed below with reference to FIGS. 1-4. However, those skilled in the art will readily appreciate that the detailed description given herein with respect to these figures is for explanatory purposes only.

FIG. 1 illustrates a portable computing device 100 in the form of a laptop computer in accordance with an example embodiment of the present disclosure. More particularly, FIG. 1 shows a front facing perspective view of the portable computing device 100 in a closed configuration. As illustrated, the portable computing device 100 may include a housing 102 comprising a base portion 104 and a lid portion 106. In the closed configuration, the lid portion 106 and the base portion 104 form what appears to be a uniform structure having a continuously varying and coherent shape that enhances both the look and feel of the portable computing device 100. In some embodiments portable computing device 100 may include a logo 108 at a rear case 110 of the lid portion 106 of the housing 102. In one embodiment, the logo 108 can be illuminated by light emitted from a display 112 (see, e.g., FIG. 2).

The base portion 104 can be pivotally connected to the lid portion 106 by way of a hinge that may include a clutch assembly in some embodiments. The base portion 104 may include an inset portion 114 suitable for assisting a user in lifting the lid portion 106 by, for example, a finger. Accordingly, the lid portion 106 of the housing 102 can be moved with respect to the base portion 104 of the housing with the aid of the clutch assembly from a closed position (see, e.g., FIG. 1) to an open position (see, e.g., FIG. 2).

Figure 2:
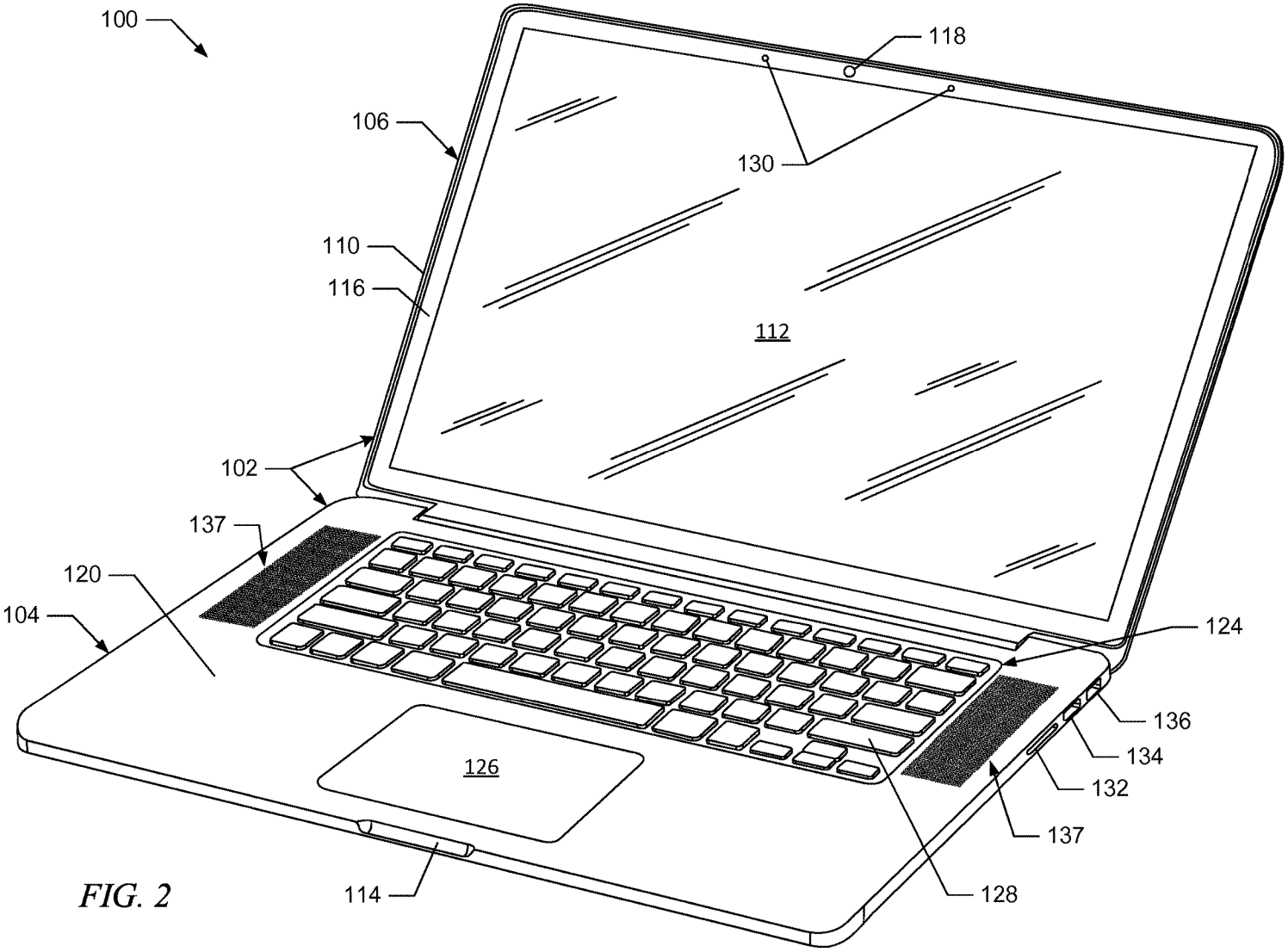
FIG. 2 illustrates the portable computing device of FIG. 1 in an open configuration according to an example embodiment of the present disclosure.

FIG. 2 shows a front facing perspective view of the portable computing device 100 in the open configuration. The display 112 may be coupled to the rear case 110 of the lid portion 106 such that the display is provided with structural support. In this regard, the lid portion 106 can be formed to have uni-body construction provided by the rear case 110 that can provide additional strength and resiliency to the lid portion which is particularly important due to the stresses caused by repeated opening and closing. In addition to the increase in strength and resiliency, the uni-body construction of the lid portion 106 can reduce overall part count by eliminating separate support features, which may decrease manufacturing cost and/or complexity.

The lid portion 106 may include a mask (also referred to as display trim) 116 that surrounds the display 112. The display trim 116 can be formed of an opaque material such as ink deposited on top of or within a protective layer of the display 112. Thus, the display trim 116 can enhance the overall appearance of display 112 by hiding operational and structural components as well as focusing attention onto the active area of the display.

The display 112 can display visual content such as a graphical user interface, still images such as photos as well as video media items such as movies. The display 112 can display images using any appropriate technology such as a liquid crystal display (LCD), a light emitting diode (LED) display, an organic light emitting diode (OLED) display, etc. Further, the portable computing device 100 may include an image capture device 118. In one embodiment the image capturing device 118 may be located on a transparent portion of the display trim 116. The image capture device 118 can be configured to capture both still and video images in some embodiments.

Figure 3:
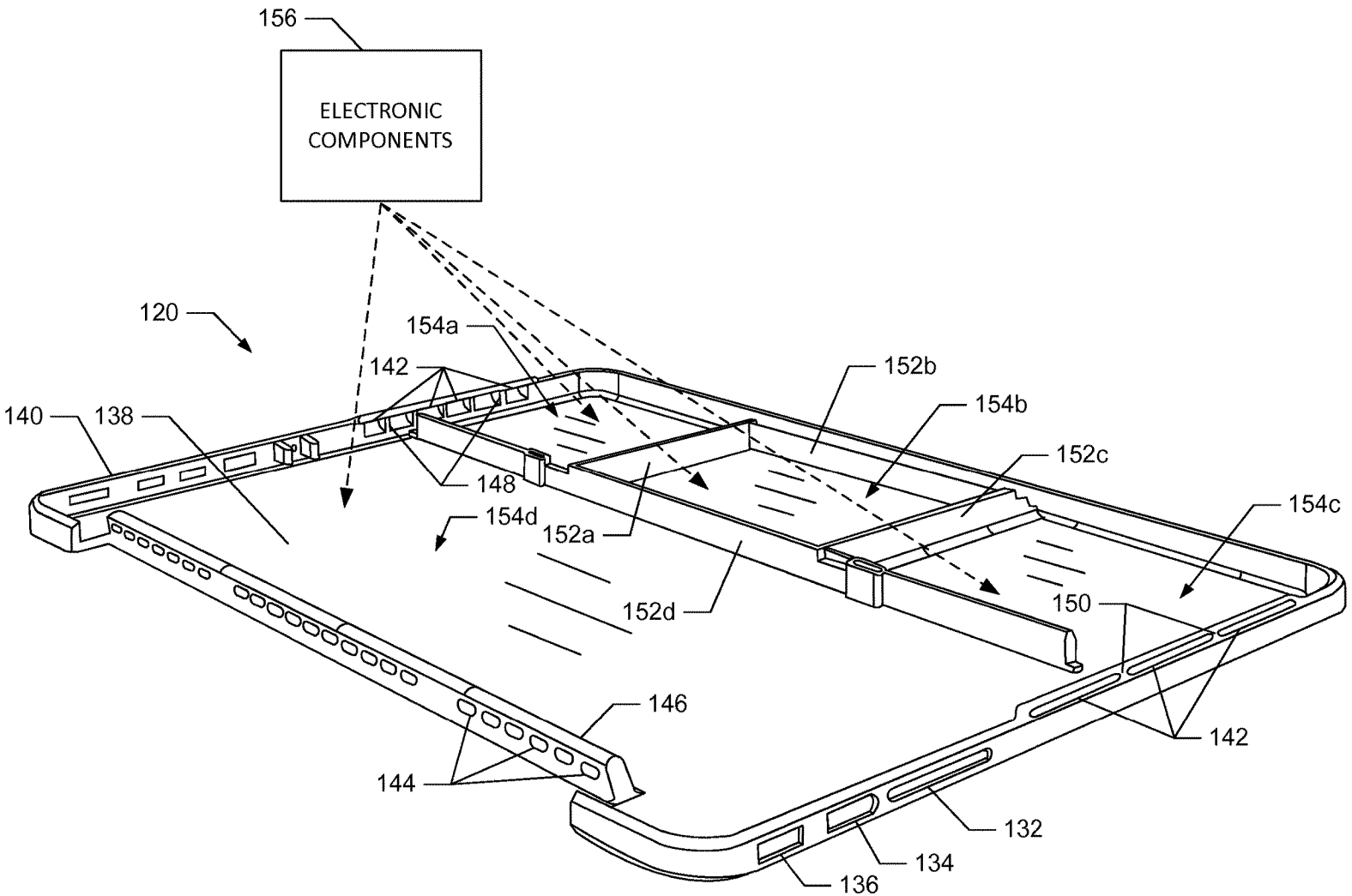
FIG. 3 illustrates a bottom perspective view of a top case of a base portion of the portable computing device of FIG. 1 according to an example embodiment of the present disclosure.
Figure 4:
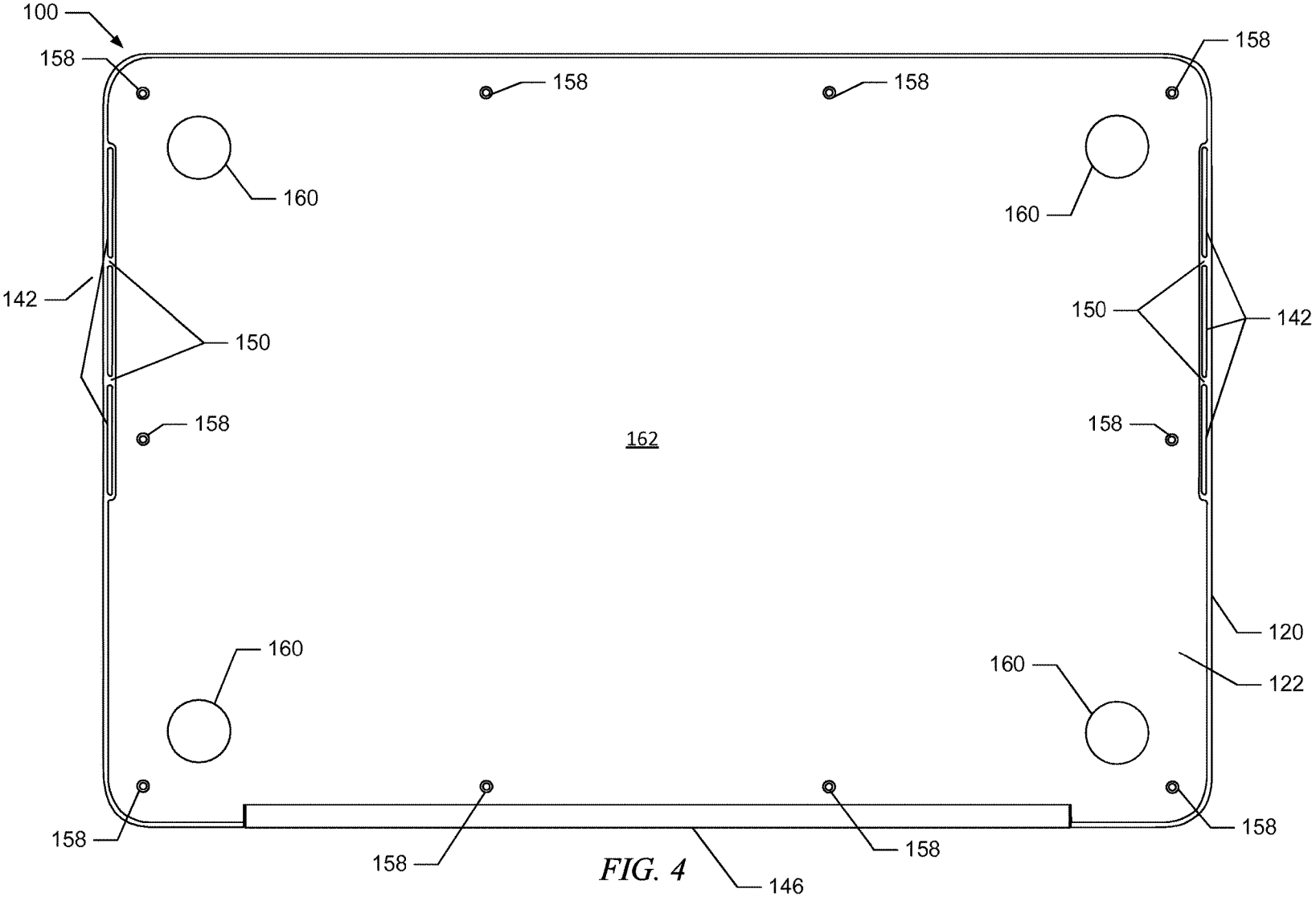
FIG. 4 illustrates a bottom view of the portable computing device of FIG. 1 according to an example embodiment of the present disclosure.

The base portion 104 may comprise a top case 120 (see, e.g., FIG. 3) fastened to a bottom case 122 (see, e.g., FIG. 4). As illustrated in FIG. 2, the top case 120 can be configured to accommodate various user input devices such as a keyboard 124 and a touchpad 126. The keyboard 124 can include a plurality of low profile keycap assemblies 128. In one embodiment, an audio transducer (not shown) can use selected portions of keyboard 124 to control output audio signals such as music. One or more microphones 130 can be located on the lid portion 106. The microphones 130 may be spaced apart to improve frequency response of an associated audio circuit.

Each of the plurality of keycap assemblies 128 can have a symbol imprinted thereon for identifying the key input associated with the particular key pad. The keyboard 124 can be arranged to receive a discrete input at each keycap assembly 128 using a finger motion referred to as a keystroke. In the described embodiment, the symbols on each keycap assembly 128 can be laser etched thereby creating an extremely clean and durable imprint that will not fade under the constant application of keystrokes over the life of portable computing device 100. In order to reduce component count, one of the keycap assemblies 128 can be re-provisioned as a power button. In this way, the overall number of components in the portable computing device 100 can be commensurably reduced.

The touchpad 126 can be configured to receive finger gesturing. A finger gesture can include touch events from more than one finger applied in unison. The gesture can also include a single finger touch event such as a swipe or a tap. The gesture can be sensed by a sensing circuit in the touchpad 126 and converted to electrical signals that are passed to a processing unit for evaluation. In this way, portable computing device 100 can be at least partially controlled by touch.

One or more data ports 132, 134, 136 can be used to transfer data and/or power between an external circuit(s) and the portable computing device 100. The data ports can include, for example, an input slot 132 that can be used to accept a memory card (such as a FLASH memory card), whereas the remaining data ports 134, 136 can be used to accommodate data connections such as USB, FireWire, Thunderbolt, and so on. Further, in some embodiments, one or more speaker grids 137 can be used to output audio from an associated audio component enclosed within base portion 104 of the housing 102.

FIG. 3 illustrates a perspective bottom view of the top case 120 of the base portion 104 of the housing 102. As illustrated, the top case 120 may comprise a major wall 138 and an outer rim 140 extending therefrom. A plurality of vents 142 may be defined in the top case 120. For example, the vents 142 are defined in the outer rim 140 in the illustrated embodiment. The vents 142 may be configured to provide a flow of outside air that can be used to cool internal components by allowing air to enter or exit therethrough. For example, the vents 142 in the outer rim 140 may comprise intake vents and a plurality of vents 144 defined in a rear wall 146 may comprise exhaust vents. In another embodiment the vents 142 in the outer rim 140 can act as a secondary air intake subordinate to primary air intake vents or the vents in the outer rim may comprise exhaust vents.

The vents 142 in the outer rim 140 can also be used to output audio signals in the form of sound generated by an audio module. Accordingly, the vents 142 can be used to output sound at a selected frequency range in order to improve quality of an audio presentation by the portable computing device 100. Additionally, the vents 142 in the outer rim 140 can be part of an integrated support system for the top case 120. In this regard, internal ribs 148 may be positioned within the vents 142 and/or external ribs 150 may be positioned between the vents to provide additional structural support to the portable computing device 100. In some embodiments the vents 142 may be machined from the material defining the top case 120 with the ribs 148, 150 comprising retained material.

The cadence and size of the vents 142 can be used to control air flow into portable computing device 100 as well as control emission of radio frequency (RF) energy in the form of electromagnetic interference (EMI) from the portable computing device. In this regard, the internal ribs 148 can separate an area within the vents 142 to produce an aperture sized to reduce passage of RF energy. The size of an aperture defined by each of the vents 142 may dictate the wavelength of RF energy that can be "trapped" by the aperture. In this case, the size of vents 142 is such that a substantial portion of RF energy emitted by internal components can be trapped within the portable computing device 100. Furthermore, by placing vents 142 at a downward facing outer surface of the top case 120, the aesthetics of portable computing device 100 can be enhanced since views of internal components from an external observer are eliminated during normal use.

As illustrated, the rear wall 146 may extend from the major wall 138. The rear wall 146 may be configured to hide the clutch at the hinge between the base portion 104 and the lid portion 106 of the housing 102. A plurality of inner sidewalls 152*a-d* may also extend from the major wall 138. The inner sidewalls 152*a-d* may divide an interior space defined by the base portion 104 into a plurality of compartments 154*a-d*.

As schematically illustrated in FIG. 3, the portable computing device 100 may include a plurality of electronic components 156, which may be received in one or more of the compartments 154*a-d*. As may be understood, by way of example, the electronic components 156 may include a mass storage device (e.g., a hard drive or a solid state storage device such as a flash memory device including non-transitory and tangible memory that may be, for example, volatile and/or non-volatile memory) configured to store information, data, files, applications, instructions or the like, a processor (e.g., a microprocessor or controller) configured to control the overall operation of the portable electronic device, a communication interface configured for transmitting and receiving data through, for example, a wired or wireless network such as a local area network (LAN), a metropolitan area network (MAN), and/or a wide area network (WAN), for example, the Internet, a fan, a heat pipe, and one or more batteries. However, various other electronic components may additionally or alternatively be received in the housing 102 of the portable electronic device as may be understood by one having skill in the art.

FIG. 4 shows an external view of the bottom of the bottom case 122 of the base portion 104 of the housing 102. One or more fasteners 158 may be positioned at the bottom case 122 of the base portion 104 of the housing 102. The fasteners 158 may be configured to secure the bottom case 122 to the top case 120 to enclose the above-described electronic components 156.

Additionally, in some embodiments the portable computing device 100 may include one or more bumpers. Bumpers may serve a variety of purposes. In this regard, in the illustrated embodiment the portable computing device 100 includes bumpers in the form of feet 160 coupled to an outer surface 162 of the bottom case 122 of the base portion 104 of the housing 102.

Devices such as the above-described portable computing device 100 may be produced by machining a substrate to define one or more components thereof. For example, computer numerical control (CNC) machining may be employed to form components of the portable computing device 100. By way of more particular example, a CNC mill may be employed to form components of the portable computing device 100.

Figure 5:
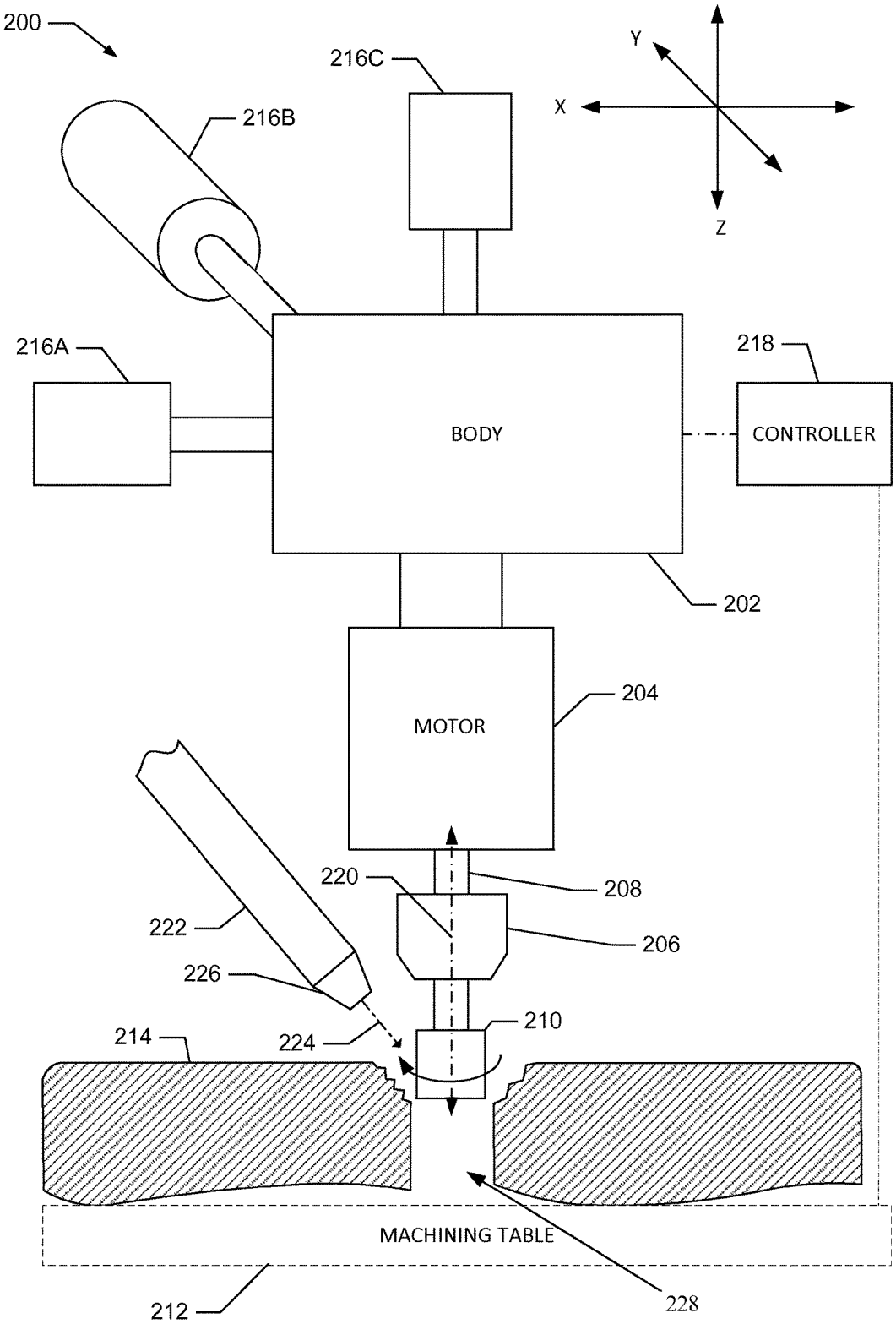
FIG. 5 schematically illustrates a computer numerical control (CNC) mill including a rotary cutter machining an aperture in a workpiece according to an embodiment of the present disclosure.

In this regard, FIG. 5 illustrates an example embodiment of a CNC mill 200 according to an example embodiment of the present disclosure. In one embodiment the CNC mill 200 may comprise a 3-axis vertical mill available from FANUC Corporation of Oshino-mura, Japan. However, various other embodiments of CNC mills may be employed in accordance with embodiments of the present disclosure.

As illustrated, the CNC mill 200 may include a machine body 202. The CNC mill 200 may further comprise a motor 204 configured to rotate a rotary head 206 coupled thereto via a spindle 208. The rotary head 206, or "tool holder," may couple to a rotary tool 210 such as any of various milling cutters. A machining table 212 may be configured to support a workpiece or substrate 214. The machining table 212 may be stationary or configured to move in one or more directions to move the workpiece 214 therewith.

Additionally, the machine body 202 or an arm or other member extending therefrom may be configured to move. In this regard, the CNC mill 200 may further comprise actuators 216A-C. In the illustrated embodiment the actuators 216A-C are configured to move the machine body 202 and, therefore, the spindle 208, rotary head 206, and the rotary tool 210 due to coupling therewith. More particularly, a first actuator 216A is configured to move the machine body 202 along an X-axis, a second actuator 216B is configured to move the machine body along a Y-axis, and a third actuator 216C is configured to move the machine body along a Z-axis. Various embodiments of actuators may be employed such as hydraulic or pneumatic actuators.

Further, the CNC mill 200 may include a controller 218. The controller 218 may direct the motor 204 to rotate, which may in turn rotate the spindle 208, the rotary head 206, and the rotary tool 210 coupled thereto about an axis 220. Further, the controller 218 may direct movement of the rotary tool 210 relative to the workpiece 214. For example, the machining table 212 may move the workpiece 214 or the actuators 216A-C may move the body 202 and/or other portion of the CNC mill 200 to move the rotary tool 210 relative to the workpiece.

The CNC mill 200 may additionally include a coolant system 222 (e.g., a flood coolant system). The coolant system 222 may be configured to direct a flow of a coolant 224 (e.g., water and/or oil) proximate the rotary tool 210 and/or the workpiece 214 to cool, protect, and/or lubricate the rotary tool and/or the workpiece. For example, the coolant system 222 may include an external nozzle 226 configured to direct the coolant 224 toward the rotary tool 210 and/or the workpiece 214.

Accordingly, the CNC mill 200 may remove material from the workpiece 214 to form a component. For example, the workpiece 214 may be machined to form the above-described top case 120 of the base portion 104 of the housing 102. By way of further example, FIG. 5 illustrates machining an aperture 228 in the workpiece 214 which may ultimately comprise a port in the top case 120 (e.g., one of the data ports 134, 136). However, depending on the characteristics of the cutting tool 210 and the desired shape of the component being formed from the workpiece 214, the cutting tool may be incapable of removing material from the workpiece 214 with a desired level of precision. Further, it may be desirable to remove sharp corners or other features from the workpiece 214 following machining or provide the workpiece with a desired surface finish (e.g., a smooth, mirrored surface finish). Accordingly, for these and various other reasons, it may be desirable to perform finishing operations on the workpiece 214.

For example, such finishing operations may include sanding micromilling, microgrinding, and microelectromilling, which may be conducted by rotating an abrasive disk or grinding wheel against the workpiece 214. The abrasive disk may comprise diamonds electroplated to a steel disk. However abrasive disks may not be configured to, or capable of, conforming to geometries of the workpiece 214. For example, the abrasive disks may be too large to fit in the aperture 228 or capable or configured to provide a desired shape at an inlet thereto (e.g., a chamfer). Further, the abrasive disks may tend to leave behind scratches and/or the abrasive disks may tend to clog with the material defining the workpiece behind finished, particularly when the workpiece comprises a soft material such as aluminum or plastic, which may limit the abrasive disks' effectiveness.

Additionally, typical abrasive brushes may be configured to polish flat surfaces, rather than complex geometries such as chamfers. In this regard, abrasive brushes may employ a plurality of relatively small diameter bristles (e.g., defining a diameter less than about 0.1 mm), which are soft and conform to the shape of the workpiece. Accordingly, the abrasive brushes may not be configured to conform to, and finish, complex geometries such as chamfers.

Figure 6:
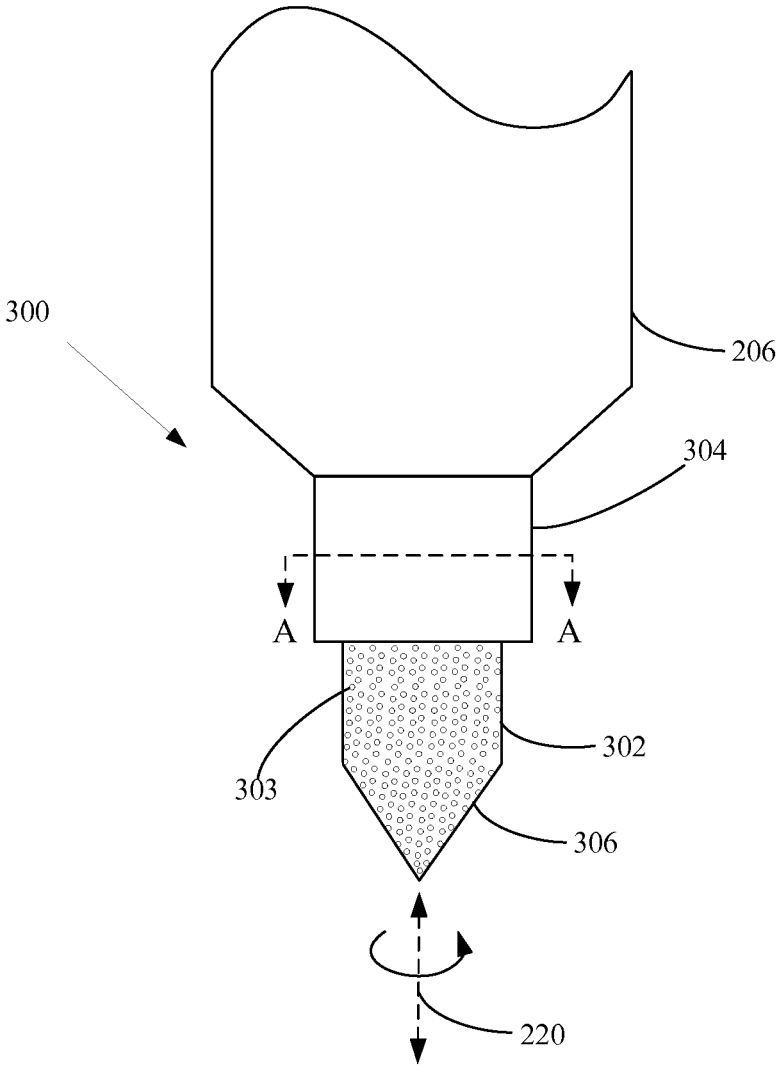
FIG. 6 illustrates a side view of a single filament abrasive brush according to an example embodiment of the present disclosure.

Accordingly, embodiments of the present disclosure provide tools configured to sand, abrade, or otherwise perform finishing operations on workpieces and components defining features that are relatively small and/or define relatively complex geometries. In this regard, FIG. 6 illustrates a single filament abrasive brush 300 in accordance with embodiments of the present disclosure. The abrasive brush 300 may differ from other embodiments of abrasive brushes at least in that a single bristle or filament 302 is employed in the abrasive brush, whereas a plurality of bristles or filaments are typically employed in existing embodiments of brushes.

The abrasive brush 300 may further differ from existing embodiments of abrasive brushes in that the filament 302 may be relatively thick. For example, the filament, which may define a round cross-section in some embodiments, may define a width or diameter greater than about 0.1 mm and more preferably from about 1 mm to about 10 mm. It should be noted that current industry practice for brushes is to produce filaments that do not exceed 0.1 mm in width or diameter, and to employ a plurality of the filaments, as noted above. Use of a relatively thick, single filament 302 may provide the abrasive brush 300 with greater strength and rigidity which may be employed to cause a workpiece undergoing finishing to take a shape thereof. In contrast, traditional abrasive brushes including a plurality of filaments may be relatively soft and may conform to a surface of a workpiece undergoing finishing operations. Thus, the filaments of a traditional abrasive brush may be substantially incapable of modifying a shape of the workpiece.

The abrasive brush 300 may be configured for receipt within a rotary head of a rotary machine in order to form a finishing system. In this regard, the abrasive brush 300 may be configured for use with the above-described CNC mill 200. Thus, as illustrated in FIG. 6, the abrasive brush 300 may be configured to couple to the rotary head 206 thereof. Accordingly, the abrasive brush 300 may be rotated about the rotational axis 220 and moved by the CNC mill 200 in any of the other manners described above. The selected rotational speed imparted by the rotary head 206 to the abrasive brush 300 can depend on the material composition of the workpiece to which the abrasive brush is being applied, or a desired surface finish of the workpiece. Further, the coolant system 222 may be configured to direct a flow of a coolant 224 (e.g., water and/or oil) proximate the abrasive brush 300 during use thereof to reduce wear on the abrasive brush 300.

As noted above, the abrasive brush 300 may include a filament 302. In some embodiments the filament 302 may comprise a thermoset resin, a ceramic material, or a thermoplastic material such as nylon. Further, the abrasive brush 300 may include a plurality of abrasive particles 303 coupled to the filament 302 (e.g., embedded therein), which may function as a polishing media. For example, the filament 302 may be impregnated with the abrasive particles 303. In this regard, by way of further example, a binding matrix may be employed to bind the abrasive particles 303 to the material (e.g., nylon) defining the filament 302. In some embodiments the abrasive particles may comprise aluminum oxide, silicon carbide, cubic boron nitride, or diamond.

The abrasive brush 300 may also include a collar 304. The collar 304 may be a substantially cylindrical tube in some embodiments, configured to receive the filament 302 therethrough. The collar 304 may support the filament 302 such that the filament retains a desired configuration. In some embodiments the collar 304 may be adjustable. In this regard, a position of the collar 304 along a longitudinal length of the filament 302, which may extend parallel to the rotational axis 220, may be adjusted. Accordingly, the collar 304 may be shifted up, in terms of the configuration of the abrasive brush 300 in FIG. 6, as the filament 302 is consumed during a finishing operation.

An end effector surface 306 of the filament 302 may be defined proximate an end thereof. The end effector surface 306 can form a specific geometry that corresponds to a desired geometry of a feature of the workpiece 214 following completion of a finishing operation thereon. In this regard, the V-shaped defined by the end effector surface 306 illustrated in FIG. 6 may be configured to finish a chamfered lip, as discussed below.

Figure 7:
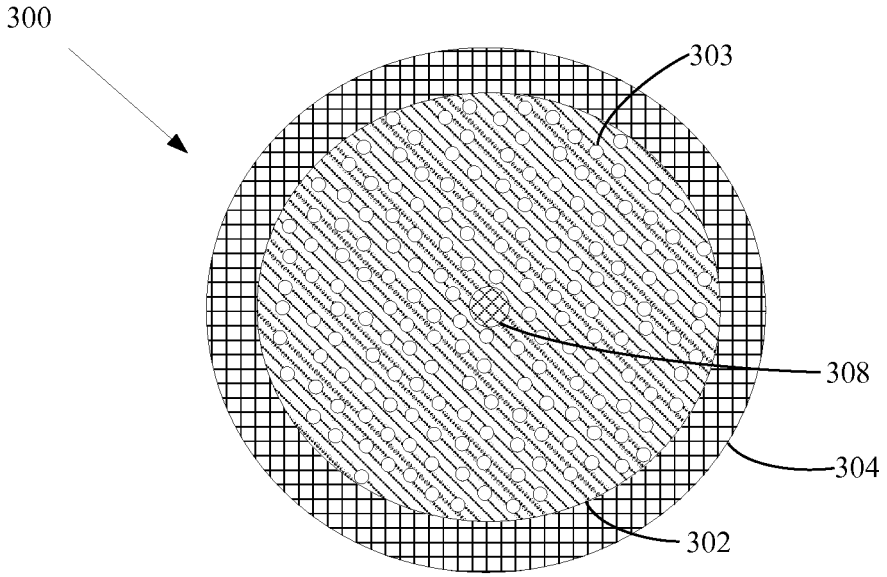
FIG. 7 illustrates a cross-sectional view through the abrasive brush of FIG. 6 along line A-A according to an example embodiment of the present disclosure.

In some embodiments, an internal support mechanism may be configured to provide the filament 302 with additional support and stability during rotation thereof. In this regard, FIG. 7 illustrates a cross-sectional view through the abrasive brush 300. As illustrated, the internal support mechanism may comprise a reinforcement member 308 (e.g., a wire or a wire mesh) extending along at least a portion of a longitudinal length of the abrasive brush, for example along a center of the filament 302.

The reinforcement member 308 can be configured such that it does not come into contact with the workpiece during a finishing operation such that the reinforcement member does not damage the workpiece 214 (e.g., by applying scratches thereto). In this regard, in some embodiments the reinforcement member may comprise a metal material, which may be harder than the material of the filament 302 and/or the material of the workpiece 214. In order to protect the workpiece 214, the reinforcement member 308 may not extend to the end effector surface 306. Further, in some embodiments a gap between the end effector surface 306 and an end of the reinforcement member 308 may correspond to usable consumable portion of the filament 302, such that the reinforcement member remains out of contact with the workpiece 214 being finished as the filament is consumed. In another embodiment the reinforcement member 308 may be adjustable, such that the reinforcement member may be retracted as the filament is consumed. For example, the reinforcement member 308 may be coupled to the collar 304, such that when the collar is adjusted upwardly, the reinforcement member retracts from the end effector surface 306 an equal distance. Alternatively, the reinforcement member 308 may extend to the end effector surface 306 in embodiments in which center of the end effector surface remains out of contact with the workpiece 214. For example, when the feature abraded by the abrasive brush 300 surrounds an aperture, the center of the end effector surface 306 may remain out of contact with the workpiece 214.

It should be noted that when the abrasive brush 300 is applied against soft materials such as aluminum, in some embodiments the abrasive brush may tend to clog up with material removed from the workpiece. Thus, when the abrasive brush 300 is employed to finish relatively soft materials such as aluminum and plastic, a hardness of the filament 302 can be specifically selected such that the filament is consumed at a rate greater than or equal to a rate at which material removed from the workpiece 214 binds to (e.g., clogs) the filament. Thus, the abrasive brush 300 may be "tuned" such that an appropriate material is employed in the filament 302 that wears away to prevent clogging thereof.

Figure 8:
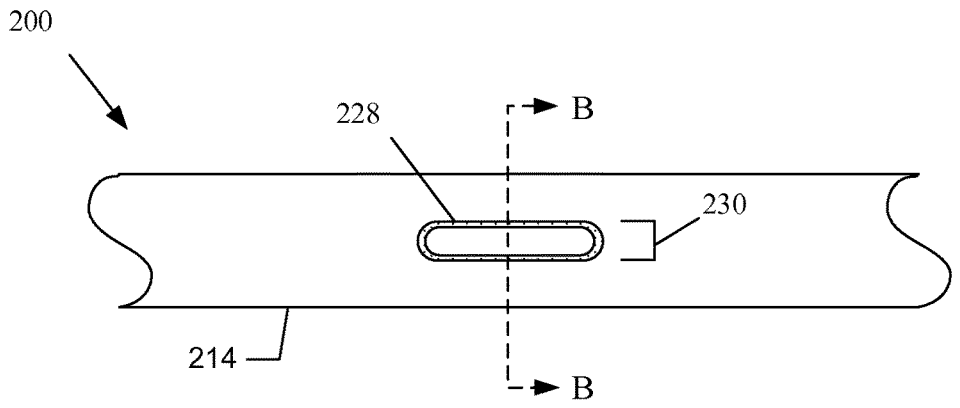
FIG. 8 illustrates an enlarged view of a portion of the workpiece of FIG. 5 proximate the aperture therein according to an example embodiment of the present disclosure.

FIG. 8 illustrates an enlarged view of a portion of the workpiece 214 proximate the aperture 228. The workpiece 214 may be finished proximate the aperture 228 using the above-described abrasive brush 300. In one embodiment the aperture 228 may be configured to receive a data connector. Thus, the aperture 228 may be relatively small and can in some embodiments define a height 230 from about 2 mm to about 3 mm, making normal grinding operations within the opening unfeasible (e.g., due to the size and/or shape of traditional grinding tools).

Figure 9:
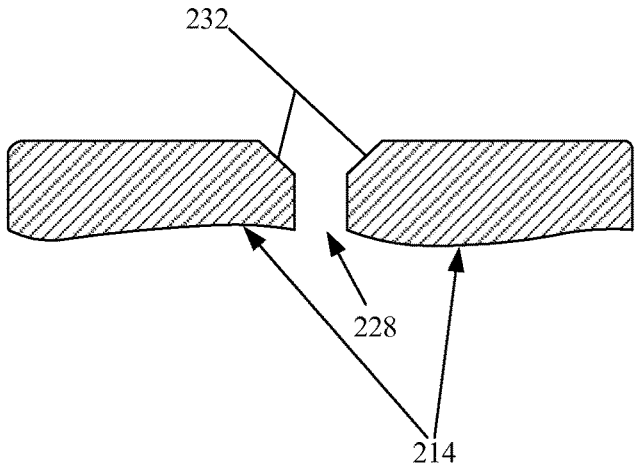
FIG. 9 illustrates a cross-sectional view along line B-B from FIG. 8 of a portion of the workpiece at the aperture according to an example embodiment of the present disclosure.

FIG. 9 illustrates a cross-sectional view along line B-B from FIG. 8 of a portion of the workpiece 214 at the aperture 228 following the completion of finishing operations thereon. As illustrated, a chamfered lip 232 may be defined at the aperture 228. A mirrored or high gloss finish can be established along the chamfered lip 232 by use of the single filament abrasive brush 300, as will be described in detail below.

Figure 10:
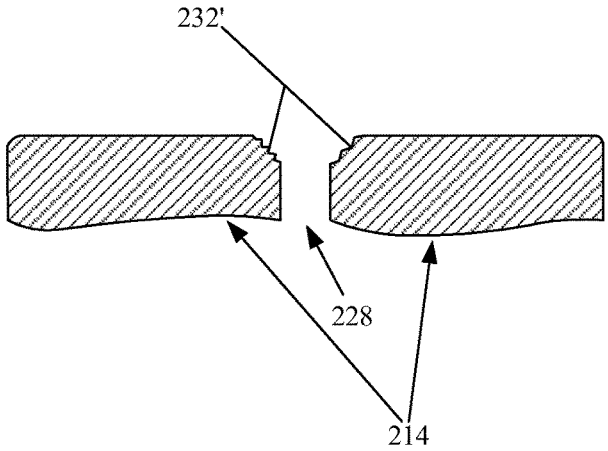
FIG. 10 illustrates a cross-sectional view along line B-B from FIG. 8 of a portion of the workpiece at the aperture wherein the chamfer defines an unfinished configuration according to an example embodiment of the present disclosure.
Figure 11:
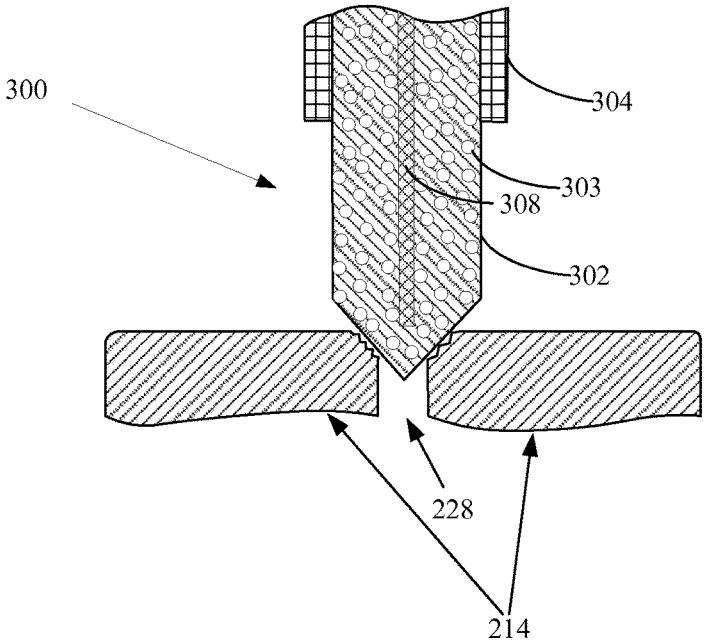
FIG. 11 illustrates a cross-sectional view along line B-B from FIG. 8 of a portion of the workpiece at the aperture during performance of a finishing operation on the unfinished chamfer of FIG. 10 with the abrasive brush of FIG. 6 according to an example embodiment of the present disclosure.
Figure 12:
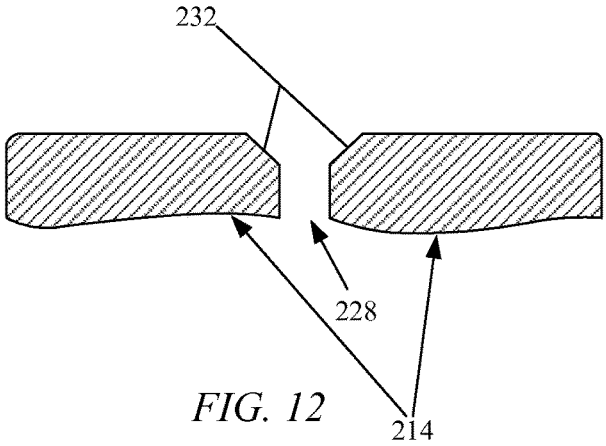
FIG. 12 illustrates a cross-sectional view along line B-B from FIG. 8 of a portion of the workpiece at the aperture wherein a chamfer defines a finished configuration according to an example embodiment of the present disclosure.

FIGS. 10-12 illustrate the production of the chamfered lip 232 at the aperture 228 in the workpiece 214. In this regard, FIG. 10 illustrates a cross-sectional view through the workpiece 214 along line B-B from FIG. 8 at the aperture 228, wherein the aperture defines an unfinished chamfered lip 232'. The unfinished chamfered lip 232' at the aperture 228 can be created as part of a separate forming process prior to performing finishing operations thereon. For example, the unfinished chamfered lip 232' may be formed with a milling cutter. As illustrated, the previous forming process may leave a degree of roughness at the unfinished chamfered lip 232' that prevents the aperture 228 from having a desired surface finish (e.g., a substantially smooth surface finish).

FIG. 11 illustrates a cross-sectional view through the workpiece 214 along line B-B from FIG. 8 at the aperture 228 during performance of a finishing operation thereon. In particular, FIG. 11 illustrates the abrasive brush 300 coming into direct contact with the workpiece 214 at the aperture 228 during performance of a finishing operation thereon. As depicted, a geometry of the end effector surface 306 of the abrasive brush 300 can correspond to a desired finished geometry of the inlet to the aperture 228. Thus, the abrasive brush 300 can be rotated against the unfinished chamfered lip 232' (see, FIG. 10) such that the abrasive particles 303 abrade the material of the workpiece 214 until, as shown in FIG. 12, a smooth surface finish is achieved along the chamfered lip 232 leading into aperture 228. In this way, the finished chamfered lip 232 may provide a smooth inlet guide that facilitates inserting a plug (e.g., an electrical and/or data connection plug) into the aperture 228.

Figure 13:
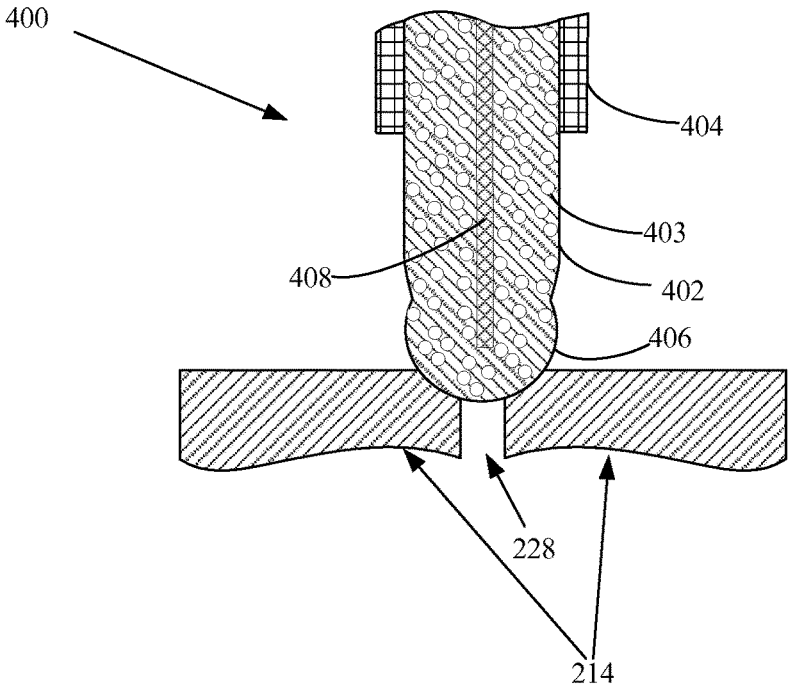
FIG. 13 illustrates a sectional view through a single filament abrasive brush wherein an end effector surface thereof is substantially rounded or ball-shaped according to an alternate example embodiment of the present disclosure.
Figure 14:
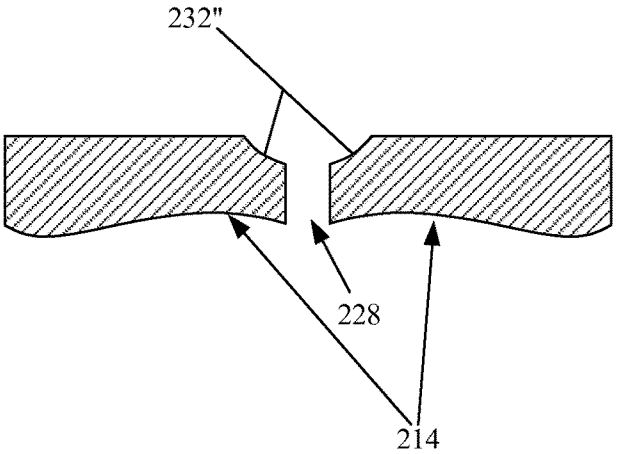
FIG. 14 illustrates a cross-sectional view along line B-B from FIG. 8 of a portion of the workpiece at the aperture including a curved lip produced by the abrasive brush of FIG. 13 according to an example embodiment of the present disclosure.

FIG. 13 illustrates an alternative embodiment of a single filament abrasive brush 400 according to the present disclosure. The abrasive brush 400 may include a filament 402, a plurality of abrasive particles 403, a collar 404, and a reinforcement member 408, as described above. However, the filament 402 may define a differing end effector surface 406, which may be substantially rounded or ball-shaped, as illustrated in FIG. 13. Use of the abrasive brush 400 including the ball-shaped end effector surface 406 can be utilized to form a curved lip 232" at the inlet to the aperture 228, as depicted in FIG. 14. Accordingly, any of various end effector geometries may be employed to define a desired shape of the lip at the inlet to the opening.

Figure 15:
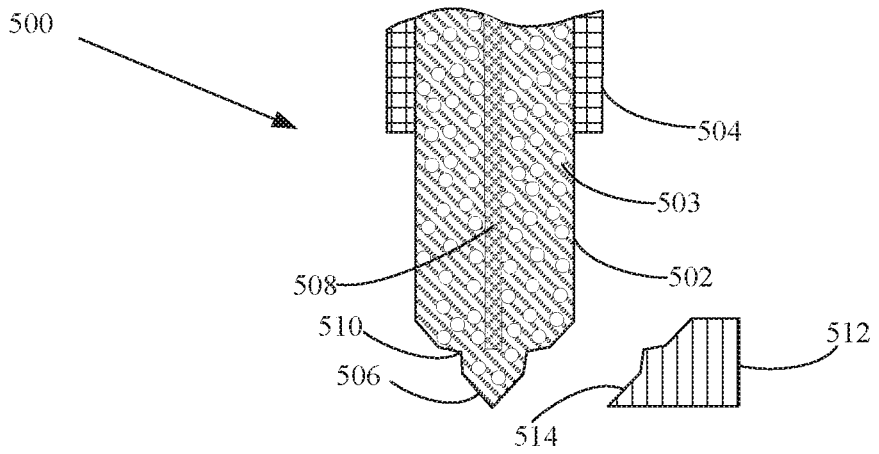
FIG. 15 illustrates a sectional view through a single filament abrasive brush and a redressing tool wherein an end effector surface of the abrasive brush is stepped according to an alternate example embodiment of the present disclosure.

By way of further example, a stepped end effector surface may define a stepped lip at the inlet to the housing. In this regard, FIG. 15 illustrates another embodiment of a single filament abrasive brush 500. The abrasive brush 500 may include a filament 502, a plurality of abrasive particles 503, a collar 504, and a reinforcement member 508, as described above. However, the filament 502 may define a differing end effector surface 506, wherein a notch 510 is present in the tip of abrasive brush 500 between stepped surfaces, which may provide a desired lip shape at the inlet to the aperture 228 in the workpiece 214.

Abrasive brushes including sharp, well-defined angles, such as are included in the abrasive brush illustrated in FIG. 15 may be prone to wear. Accordingly, in some embodiments the abrasive brushes disclosed herein can be periodically redressed (e.g., re-cut) to ensure that the geometry of the end effector surface matches a desired geometry. For example, portions of the abrasive brush 500 coming into more frequent contact with the workpiece than other portions can wear away more quickly such that a geometry of the end effector surface of the abrasive brush is altered. Accordingly, a tool may be included in the finishing system that is employed to redress the end effector surface of the abrasive brush.

For example, FIG. 15 further illustrates a redressing tool 512 (e.g., a carbide cutting tool) that can reshape the end effector surface 506 of the abrasive brush 500 by cutting the filament 502 when the abrasive brush is rotated thereagainst. Such an operation may be conducted periodically to return the end effector surface of the abrasive brush to its original geometry. In this regard, the redressing tool 512 may be sized and shaped such that a cutting edge 514 thereof is configured to match a desired shape (e.g., the original shape) of the end effector surface 506. Note that although a particular configuration of the cutting edge of the redressing tool is illustrated, the configuration of the redressing tool may vary in order to cause the redressed filament to define a desired shape. Note further that the redressing tool 512 may in some embodiments be configured to cut and redress the reinforcement member 508 during the redressing operation, such that both the filament 502 and the reinforcement are returned to a desired shape.

Figure 16:
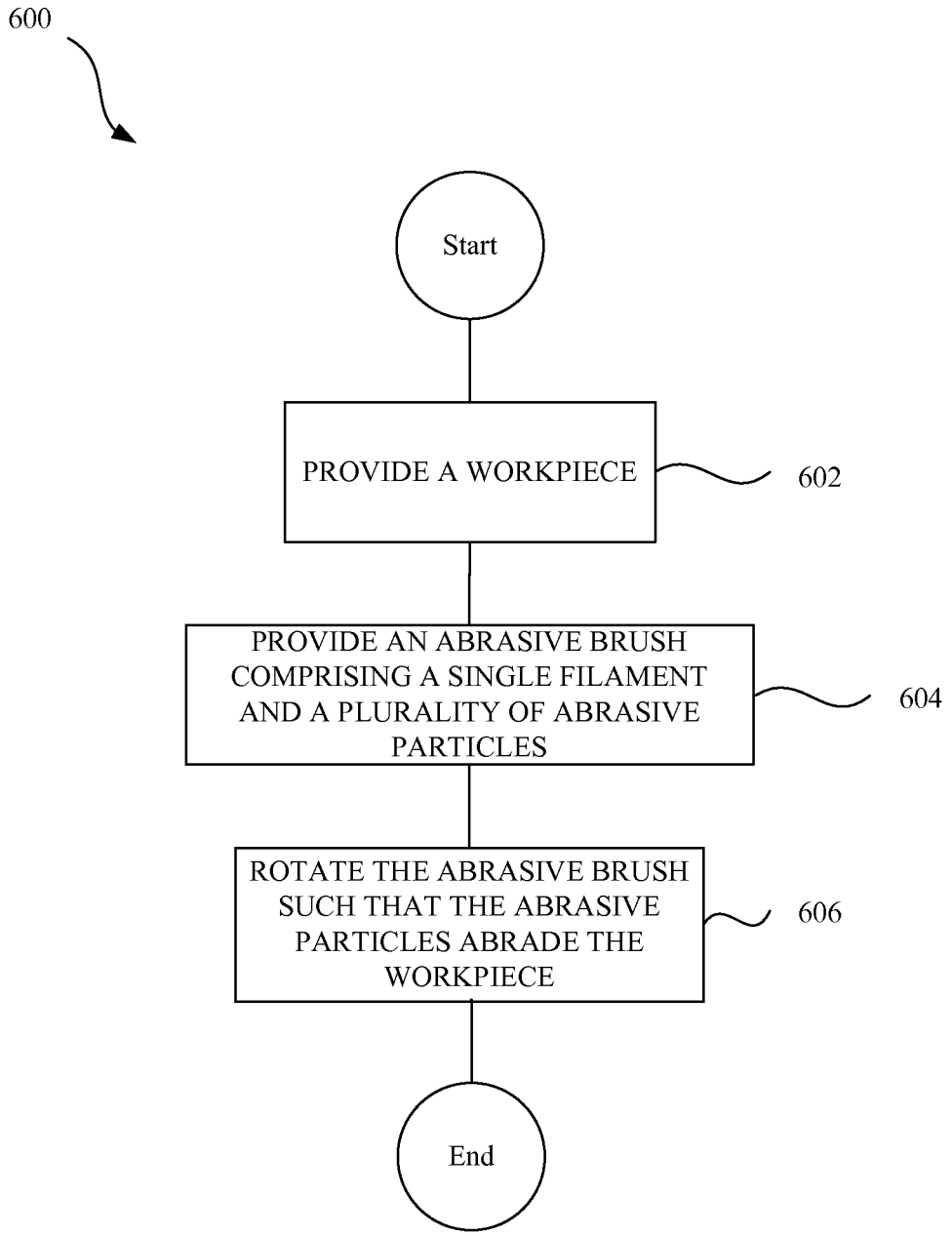
FIG. 16 schematically illustrates a finishing method according to an example embodiment of the present disclosure.

FIG. 16 illustrates a finishing method 600 which may be employed to finish a workpiece. As illustrated, the finishing method 600 may include providing a workpiece at operation 602. Further, the method may include providing an abrasive brush at operation 604. The abrasive brush may comprise a single filament defining an end effector surface and a plurality of abrasive particles coupled to the single filament. The method may additionally include rotating the abrasive brush about an axis extending along a longitudinal length of the single filament such that the abrasive particles abrade the workpiece at operation 606.

In some embodiments the finishing method 600 may further comprise adjusting a position of a collar of the abrasive brush at least partially surrounding the single filament. Further, the finishing method 600 may include redressing the end effector surface of the single filament with a redressing tool. The finishing method 600 may additionally include selecting a hardness of the single filament such that the single filament is consumed at a rate greater than or equal to a rate at which material removed from the workpiece binds to the single filament. The finishing method 600 may also include directing a flow of a coolant proximate the abrasive brush. The finishing method 600 may further comprise providing a cutter and rotating the cutter to cut the workpiece prior to abrading the workpiece with the abrasive brush. Additionally, the finishing method 600 may include selecting the end effector surface of the single filament to match a desired shape of a feature of the workpiece. In some embodiments, the finishing method 600 may also include one or more additional finishing operations such as polishing or anodizing operations.

Accordingly, as described above, an appropriate abrasive brush is chosen for the workpiece material and desired geometry of the workpiece. The abrasive brush is rotated in contact with surfaces of a workpiece requiring the finishing process. As the single filament is consumed (e.g., due to friction with the workpiece), the collar can be adjusted to expose an additional length of the single filament. The end effector surface of the abrasive brush may be periodically redressed. The redressing time interval can correspond to a complexity of the tip and an amount of material removal that is required. Further, a finish of the workpiece may be inspected, and additional abrasion with the abrasive brush may be conducted when appropriate.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

Figure 17:
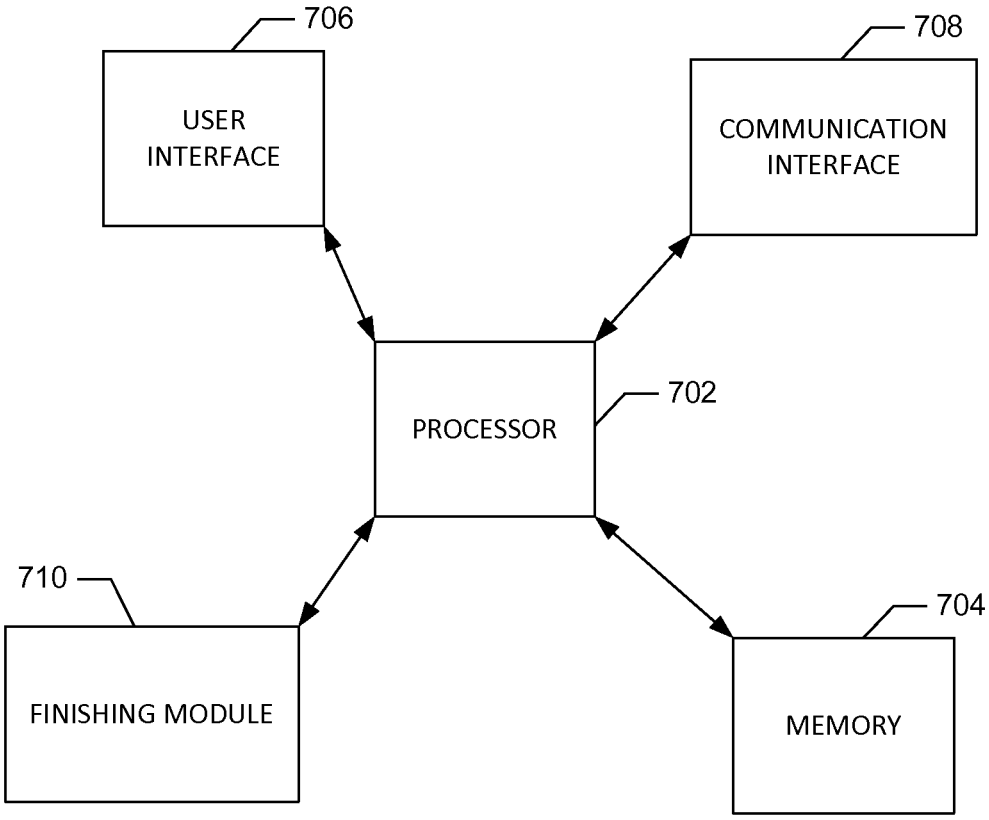
FIG. 17 schematically illustrates a block diagram of an electronic device according to an example embodiment of the present disclosure.

In this regard, FIG. 17 is a block diagram of an electronic device 700 suitable for use with the described embodiments. In one example embodiment the electronic device 700 may be embodied in or as a controller configured for controlling manufacturing operations as disclosed herein. In this regard, the electronic device 700 may be configured to control or execute the above-described manufacturing and finishing operations performed by the CNC mill 200 (see, FIG. 5). In this regard, the electronic device 700 may be embodied in or as the controller 218 (see, FIG. 5).

The electronic device 700 illustrates circuitry of a representative computing device. The electronic device 700 may include a processor 702 that may be microprocessor or controller for controlling the overall operation of the electronic device 700. In one embodiment the processor 702 may be particularly configured to perform the functions described herein relating to manufacturing and finishing. The electronic device 700 may also include a memory device 704. The memory device 704 may include non-transitory and tangible memory that may be, for example, volatile and/or non-volatile memory. The memory device 704 may be configured to store information, data, files, applications, instructions or the like. For example, the memory device 704 could be configured to buffer input data for processing by the processor 702. Additionally or alternatively, the memory device 704 may be configured to store instructions for execution by the processor 702.

The electronic device 700 may also include a user interface 706 that allows a user of the electronic device 700 to interact with the electronic device. For example, the user interface 706 can take a variety of forms, such as a button, keypad, dial, touch screen, audio input interface, visual/image capture input interface, input in the form of sensor data, etc. Still further, the user interface 706 may be configured to output information to the user through a display, speaker, or other output device. A communication interface 708 may provide for transmitting and receiving data through, for example, a wired or wireless network such as a local area network (LAN), a metropolitan area network (MAN), and/or a wide area network (WAN), for example, the Internet.

The electronic device 700 may also include a finishing module 710. The processor 702 may be embodied as, include or otherwise control the finishing module 710. The finishing module 710 may be configured for controlling or executing the finishing operations and associated operations as discussed herein.

In this regard, for example, in one embodiment a computer program product comprising at least one computer-readable storage medium having computer-executable program code portions stored therein is provided. The computer-executable program code portions, which may be stored in the memory device 704, may include program code instructions for performing the finishing operations and associated operations disclosed herein.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. An abrasive brush for processing a workpiece, comprising:

a single filament having a length, the single filament including:

a reinforcement member coupled to an adjustable collar, the reinforcement member extending within the single filament and along a portion of the length of the single filament; and an end effector surface extending past a distal end of the reinforcement member, the single filament being configured to rotate about an axis extending along the length of the single filament such that consumable abrasive particles of the end effector surface abrade the workpiece, wherein the reinforcement member is retractable from the end effector surface in accordance with a position of the adjustable collar such that the reinforcement member is prevented from damaging the workpiece as the consumable abrasive particles are consumed.

2. The abrasive brush of claim 1, further comprising a motor that is configured to rotate the single filament about the axis.

3. The abrasive brush of claim 1, wherein an aperture is capable of being formed within the workpiece by the end effector surface, the aperture having a size and shape that corresponds to the end effector surface.

4. The abrasive brush of claim 1, wherein a hardness of the single filament is selected in accordance with a clogging rate associated with processing the workpiece.

5. The abrasive brush of claim 1, wherein the consumable abrasive particles are comprised of at least one of aluminum oxide, silicon carbide, cubic boron nitride, or diamond.

6. The abrasive brush of claim 1, wherein the single filament is characterized as having a width from about 1 mm to about 10 mm.

7. The abrasive brush of claim 1, wherein the reinforcement member is disposed concentrically within the single filament.

8. The abrasive brush of claim 1, wherein the reinforcement member is comprised of a material that is harder than the consumable abrasive particles.

9. The abrasive brush of claim 1, wherein the end effector surface defines a V-shape configured to finish a chamfered lip on the workpiece.

10. An abrasive finishing tool for processing a workpiece, comprising:

a single filament characterized as having a length, the single filament being capable of rotating relative to an axis extending along the length, and the single filament including:

an end effector surface having consumable abrasive particles for abrading the workpiece; and a reinforcement member that extends within the single filament and is coupled to an adjustable collar, wherein the adjustable collar adjusts a position of the reinforcement member along the length such as to continue to expose an amount of the end effector surface to extend distally past the reinforcement member as the consumable abrasive particles are consumed to prevent the reinforcement member from damaging the workpiece.

11. The abrasive finishing tool of claim 10, further comprising a motor that is configured to rotate the single filament relative to the axis.

12. The abrasive finishing tool of claim 10, further comprising a coolant system configured to direct a flow of a coolant proximate to the single filament.

13. The abrasive finishing tool of claim 10, wherein the adjustable collar is a substantially cylindrical tube that is parallel to the axis.

14. The abrasive finishing tool of claim 10, wherein an aperture is formed within the workpiece that corresponds to a size and shape of the end effector surface.

15. The abrasive finishing tool of claim 10, wherein the consumable abrasive particles are comprised of at least one of aluminum oxide, silicon carbide, cubic boron nitride, or diamond.

16. A method for forming an aperture in a workpiece, comprising:

providing the workpiece;

providing an abrasive brush that includes a single filament and a reinforcement member that extends within and along a portion of a longitudinal length of the single filament, the reinforcement member being coupled to an adjustable collar, wherein the single filament includes consumable abrasive particles that form a distal end effector surface;

abrading the workpiece to form the aperture by rotating the abrasive brush relative to an axis of the longitudinal length of the single filament, the aperture having a size and shape that corresponds to the distal end effector surface; and adjusting the adjustable collar to retract the reinforcement member from the distal end effector surface to prevent the reinforcement member from damaging the workpiece as the consumable abrasive particles are consumed during the abrading.

17. The method of claim 16, wherein the distal end effector surface defines a V-shape configured to finish a chamfered lip on the workpiece.

18. The method of claim 16, further comprising:

redressing the distal end effector surface with a redressing tool.

19. The method of claim 16, further comprising: directing a flow of a coolant proximate the abrasive brush.

20. The method of claim 16, wherein, prior to abrading the workpiece, the method further comprises:

cutting the workpiece.

* * * * *